US009919196B2

(12) United States Patent
Gellman

(10) Patent No.: US 9,919,196 B2
(45) Date of Patent: Mar. 20, 2018

(54) RACK FOR DISPLAYING AND MOUNTING GEAR EQUIPMENT

(71) Applicant: Thatcher Thornburg Gellman, La Crescenta, CA (US)

(72) Inventor: Thatcher Thornburg Gellman, La Crescenta, CA (US)

( * ) Notice: Subject to any disclaimer, the term of this patent is extended or adjusted under 35 U.S.C. 154(b) by 0 days.

(21) Appl. No.: 15/163,166

(22) Filed: May 24, 2016

(65) Prior Publication Data

US 2017/0340944 A1 Nov. 30, 2017

(51) Int. Cl.

| | |
|---|---|
| ***A47F 7/00*** | (2006.01) |
| ***A47G 29/00*** | (2006.01) |
| ***A47B 43/00*** | (2006.01) |
| ***A47B 47/00*** | (2006.01) |
| ***A47B 57/00*** | (2006.01) |
| ***A63B 71/00*** | (2006.01) |
| ***A47B 81/00*** | (2006.01) |
| ***A47F 7/19*** | (2006.01) |
| ***A47F 5/08*** | (2006.01) |
| ***A47G 25/06*** | (2006.01) |
| ***A47F 7/24*** | (2006.01) |
| ***A47F 8/00*** | (2006.01) |

(52) U.S. Cl.

CPC ..... *A63B 71/0036* (2013.01); *A47B 81/00* (2013.01); *A47F 5/0876* (2013.01); *A47F 7/19* (2013.01); *A47F 7/24* (2013.01); *A47F 8/00* (2013.01); *A47G 25/0664* (2013.01); *A47G 25/0671* (2013.01)

(58) Field of Classification Search

CPC ... A63B 71/0036; A47B 81/00; A47F 5/0876; A47F 7/19; A47F 7/24; A47F 8/00; A47F 5/08; A47F 5/04; A47G 25/0664; A47G 25/06; A47G 25/0671; A47G 25/0685; D06F 7/04; D06F 57/08

USPC ..... 211/85.3, 85.7, 196, 205, 30, 33, 87.01; 223/66, 85, 120

See application file for complete search history.

(56) References Cited

U.S. PATENT DOCUMENTS

| | | | | | |
|---|---|---|---|---|---|
| 1,409,852 | A * | 3/1922 | Harvey | A47G 25/0671 | 211/1 |
| 1,804,069 | A * | 5/1931 | Stover | A47G 25/0671 | 211/1 |
| 1,996,552 | A * | 4/1935 | Schwender | A47B 1/003 | 211/100 |
| 3,189,380 | A * | 6/1965 | Reguitti | A47C 7/64 | 211/195 |
| 3,592,343 | A * | 7/1971 | Swett | A47G 25/743 | 211/113 |
| 4,289,243 | A * | 9/1981 | Arbuzoff | A47L 23/20 | 211/100 |

(Continued)

*Primary Examiner* — Jennifer E. Novosad

(74) *Attorney, Agent, or Firm* — Sheppard Mullin Richter & Hampton LLP

(57) ABSTRACT

A rack for storing equipment gear and methods for using the same are provided. In one embodiment, the equipment gear rack includes a base with a plurality of structural members for storing and displaying an equipment gear set. The plurality of structural members may include a helmet display member with an angled protruding body for supporting a head piece. In other embodiments, the equipment gear rack may also include a pair of protruding arm members for storing gloves and a hook member for hanging equipment gear.

8 Claims, 6 Drawing Sheets

(56) References Cited

U.S. PATENT DOCUMENTS 4,545,514 A * 10/1985 Toy ..... A47F 8/02 223/66
4,627,544 A * 12/1986 Scarpa ..... A47F 5/14 211/182
4,747,494 A * 5/1988 Tyson ..... A47F 5/04 211/133.4
4,792,071 A * 12/1988 Scarpa ..... A47G 25/0671 223/120
4,890,749 A * 1/1990 Walter ..... A47G 25/0664 211/182
5,221,012 A * 6/1993 Licari ..... A47F 5/0876 211/105
5,265,779 A * 11/1993 Jiang ..... A41H 5/01 223/66
5,310,099 A * 5/1994 Claas ..... A47F 8/00 223/66
5,377,849 A * 1/1995 Martin ..... A47F 8/02 211/182
D363,613 S * 10/1995 Ehrmann ..... D6/316
5,503,312 A * 4/1996 Kassner ..... A47F 7/065 211/182
5,509,545 A * 4/1996 Banke ..... A47G 25/0671 211/205
5,592,750 A * 1/1997 Eichten ..... D06F 59/02 223/70
6,073,783 A * 6/2000 Allman ..... F26B 25/18 211/85.3
6,164,465 A * 12/2000 Schroeder ..... A47B 43/00 211/149
6,216,887 B1 * 4/2001 Soo ..... A47G 25/0671 211/189
6,591,994 B1 * 7/2003 Bearss ..... A63B 71/0036 211/189
D479,423 S * 9/2003 Mahoney ..... D6/552
6,749,073 B2 * 6/2004 McNab ..... A47G 25/0671 211/205
6,880,711 B2 * 4/2005 Collier ..... A47G 25/0671 211/85.3
6,978,904 B1 * 12/2005 Lam ..... A47G 25/0671 211/1
7,025,215 B2 * 4/2006 Bain ..... A47G 25/0664 211/85.31
7,077,301 B2 * 7/2006 Dudley ..... A47F 8/00 223/120
D535,512 S * 1/2007 Eastman ..... D6/552
7,168,263 B1 * 1/2007 Zenner ..... F25D 3/06 62/457.1
7,942,747 B2 * 5/2011 Cole ..... A47B 47/00 211/100
8,210,365 B2 * 7/2012 Van Wyk ..... A47B 81/00 211/85.3
8,393,482 B2 * 3/2013 Durham ..... A47L 23/205 211/182
8,418,860 B2 * 4/2013 Rimmer ..... D06F 57/04 211/196
8,966,781 B1 * 3/2015 McKernan ..... A61L 2/16 211/189
9,126,737 B2 * 9/2015 Pickering ..... B65D 85/00
9,179,789 B1 * 11/2015 Fitzgerald ..... A47F 7/00
2002/0011502 A1 * 1/2002 Preyss ..... A47F 7/22 223/120
2007/0102383 A1 * 5/2007 Evans ..... A47G 25/0671 211/85.7
2007/0278365 A1 * 12/2007 Jackson ..... A47B 83/00 248/176.1
2009/0071922 A1 * 3/2009 Barra ..... F16M 11/28 211/85.3
2009/0250562 A1 * 10/2009 Jupitz ..... A47F 8/00 248/121
2011/0036794 A1 * 2/2011 Schott ..... A47G 25/0671 211/85.3
2013/0082016 A1 * 4/2013 Arrow ..... A63B 71/00 211/85.1
2013/0098855 A1 * 4/2013 Ewald ..... A47F 5/08 211/87.01
2015/0083678 A1 * 3/2015 Baughman ..... G09F 15/0056 211/85.3

* cited by examiner

RACK FOR DISPLAYING AND MOUNTING GEAR EQUIPMENT

TECHNICAL FIELD

The present disclosure relates generally to a gear rack. More particularly, some embodiments relate to a gear rack for displaying and storing gear equipment.

BACKGROUND OF THE INVENTION

Recreational activities often require the use of various gear equipment in order to ensure the safety and comfort of the participant. Such equipment pieces or gear may include gloves, helmets, backpacks, goggles, and uniform attire by way of example only. However, because the various gear equipment come in a wide range of distinct shapes and sizes, they often cannot be displayed in one organized space or area with the use of conventional hangers or storage equipment. Indeed, not only are conventional racks and hangers not configured to display or store a plurality of gear equipment, but such conventional racks and hangers are not adapted to hold or support large and heavy sports equipment without breaking or properly storing the equipment gear.

As such, various gear equipment often become displaced or lost when they are scattered and stored in various different areas, especially when they are placed in closets, boxes, or shelves that are not easily viewable or accessible. This is particularly problematic for users who wear or use gear equipment on a daily or frequent basis, especially since conventional racks and hangers do not allow users to quickly and easily determine if he or she has all the necessary equipment in a single specified area.

Additionally, conventional hangers and racks do not allow a person to display gear equipment in an aesthetically pleasing and compact fashion. This is particularly important when the equipment gear has sentimental value or is a limited edition collector's item, especially since the user may wish to display the equipment gear rather than storing them in closets or boxes.

SUMMARY

Embodiments of the technology described herein includes a rack for displaying and storing gear equipment. In accordance with one embodiment, an apparatus includes a base or a backing with a plurality of structural members for displaying an equipment gear set.

In some embodiments, the base may include a plurality of structural members, such as a helmet display member with an angled protruding body with a top end and a bottom end for supporting a head piece. The top end of the angled protruding body may be configured to receive the head piece while the bottom end may be affixed to the base of the equipment gear rack.

In further embodiments, the base may also include a pair of protruding arms with a first end and a second end. The first end of the pair of protruding arms may receive the equipment gear for display and the second end may be affixed to the base of the equipment gear rack.

In some embodiments, the base may also include a hook member for hanging equipment gear. Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the accompanying figures. The drawings are provided for purposes of illustration only and merely depict typical or example embodiments of the invention. These drawings are provided to facilitate the reader's understanding of the apparatus and methods described herein, and shall not be considered limiting of the breadth, scope, or applicability of the claimed invention.

Some of the figures included herein illustrate various embodiments of the invention from different viewing angles. Although the accompanying descriptive text may refer to elements depicted therein as being on the "top," "bottom," or "side" of an apparatus, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS

Embodiments of the systems and methods described herein provide a rack for displaying and storing gear equipment. As described above, a plurality of gear equipment is often utilized together when participating in certain recreational activities, such as motor bike riding, mountain bike riding, snowboarding, skateboarding, and football by way of example only. As such, various embodiments described herein depict an improved rack for storing and displaying gear equipment of various sizes and shapes.

Figure 1:
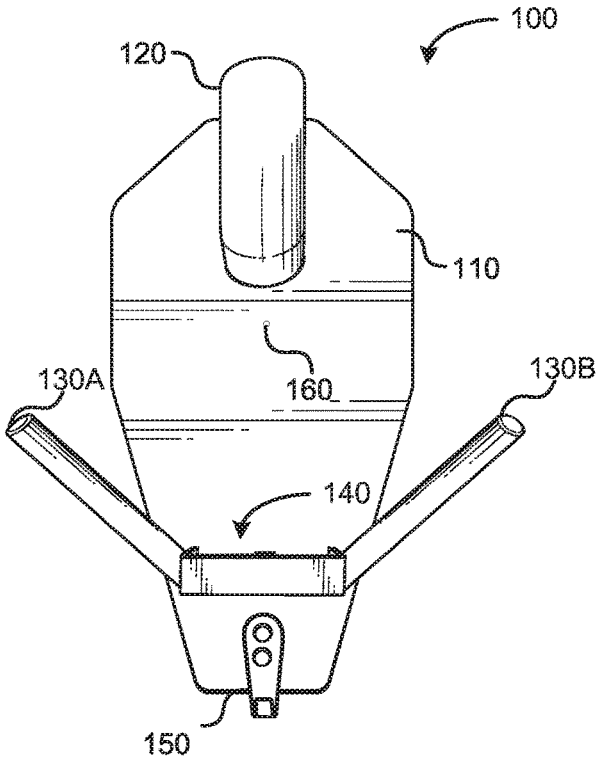
FIG. 1 is a diagram illustrating an exemplary single mounting rack for displaying and storing gear equipment in accordance with one embodiment described herein.

FIG. 1 is a diagram illustrating an exemplary single mounting rack 100 for displaying and storing gear equipment in accordance with one embodiment described herein. As depicted, the exemplary single mounting rack 100 includes a base or backing 110 with a flat surface, so that the single mounting rack 100 may be hanging flat against a wall. In some instances, the backing 110 may be nailed onto a wall via the mounting hole 160. In other instances, the mounting hole 160 may include a hook receptacle configured to receive a hook (not shown here) so that the single mounting rack 100 may be hanging from a hook attached to a wall or suspended from a ceiling. By way of example only, the backing 110 of the single mounting rack 100 may have a length ranging from 8 inches to 20 inches and a width of 4 of 12 inches. Furthermore, the backing 110 may be made of wood, metal, injected plastic, vinyl, or any other material appreciated by one or ordinary skill in the art studying the disclosure.

In order to accommodate a wide range of gear equipment to be stored and displayed on the single mounting rack 100, the backing 110 may include a helmet display member 120 for displaying hats, helmets, masks, and the like. The body of the helmet display member 120 may include an angled protruding body with a top end and a bottom end, such that the top end is configured to receive and support the head piece, such as a hat, helmet, or mask with the second end affixed to the backing 110. By way of example only, the angled protruding body may have an angle ranging from 20 to 90° so that the head piece may be stably displayed without falling off of the helmet display member 120.

However, it should be noted that the helmet display member 120 is not limited to solely displaying hats, helmets, and masks. Instead, the helmet display member 120 may store any gear equipment that may be stably placed over the helmet display member 120, as would be appreciated by any one of ordinary skill in the art studying this disclosure. By way of example only, such gear equipment may include clothing, sports gear attire, goggles, shoes, or any tools or accessories with a strap member that may be placed over the helmet display member 120.

Additionally, the single mounting rack 100 may also include a pair of protruding arm members 130A and 130B for placing and displaying gloves. To ensure that the gloves do not fall off of the protruding arm members 130A and 130B, the protruding arm members 130A and 130B may be angled anywhere from 20° to 90°. Here also, the protruding arm members 130 are not limited to displaying or storing gloves on the single mounted rack 100. Instead, the protruding arm members 130A and 130B may be utilized to display or store any gear equipment that may be stably stored and supported by the protruding arm members 130A and 130B. By way of example only, such gear equipment may include clothing, sports gear attire, backpacks, shoes, hats, helmets, masks, goggles, or any tools or accessories with a strap member that may be placed over the protruding arm members 130A and 130B.

Furthermore, the single mounting rack 100 may also include a hook member 150 so that clothing or sports gear attire may hang from the single mounting rack 100. In some embodiments, the clothing or sports gear attire may be hanging from a hanger, so that the hanger may then be placed over the hook 150. By way of example only, the clothing or sports gear attire may include uniforms, wetsuits, motor bike jackets, sports jerseys, sports uniforms, scuba gear, life jackets, etc. In other instances, the clothing or sports gear attire may be directly placed over the hook member 150 without the use of a hanger.

It should be further noted that the hook member 150 need not be limited to hanging a hanger or clothing. Instead, the hook member 150 may be used to hang any equipment gear as would be appreciated by one of ordinary skill in the art studying the disclosure. Such exemplary equipment gear may include hats, helmets, masks, shoes, goggles, or any tools or accessories that may be stably displayed and placed over the hook member 150.

Figure 2:
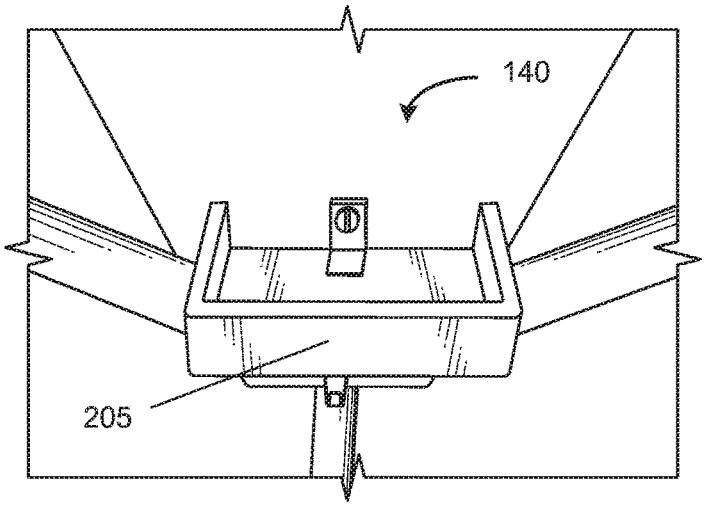
FIG. 2 is a diagram illustrating a compartment area on a single mounting rack for displaying and storing gear equipment in accordance with one embodiment described herein.

In some embodiments, the single mounting rack 100 may include a compartment area 140 for storing other miscellaneous gear equipment or items that may not be properly displayed or placed over the other structural members of the single mounting rack 100. FIG. 2 is a diagram illustrating a compartment area 140 as depicted in FIG. 1. As such, FIG. 1 and FIG. 2 will now be explained here together.

As depicted in FIG. 2, the compartment area 140 may include a 3-sided wall 205 attached to the backing 110 of the single mounting rack 100. As such, a compartment area 140 may be used to store miscellaneous items that cannot be displayed or adequately stored via the structural support members on the single mounting rack 100. For example, some miscellaneous items that may be stored in the compartment area 140 may include goggles, sunglasses, keys, tools, jewelry, chalk, writing utensils, and the like.

Figure 3:
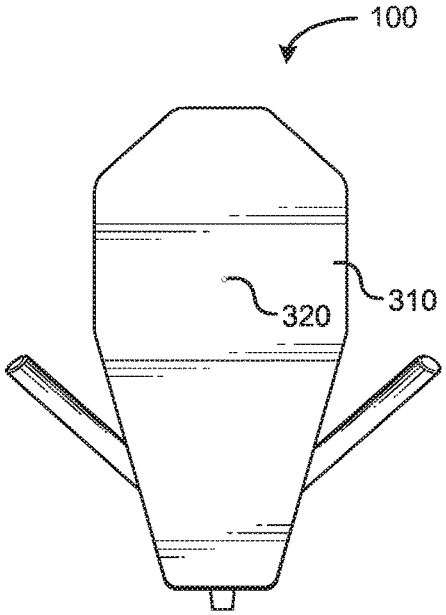
FIG. 3 is a diagram illustrating a rear view of an exemplary single mounting rack for displaying and storing gear equipment in accordance with one embodiment described herein.

FIG. 3 is a diagram illustrating a rear view of FIG. 1 of an exemplary single mounting rack 100 for displaying and storing gear equipment in accordance with one embodiment described herein. As depicted, the rear backing 310 is flat, which allows the rear backing 310 to abutted flat next to the surface of a wall.

The single mounting rack 100 may also include a mounting hole 320, so that the backing 310 may be securely nailed onto a wall or flat surface. While FIG. 3 depicts a single mounting hole 320, a plurality of mounting holes may be placed at various areas on the single mounting rack 100 so that the single mounting rack 100 may be securely mounted onto a wall or surface.

Figure 4:
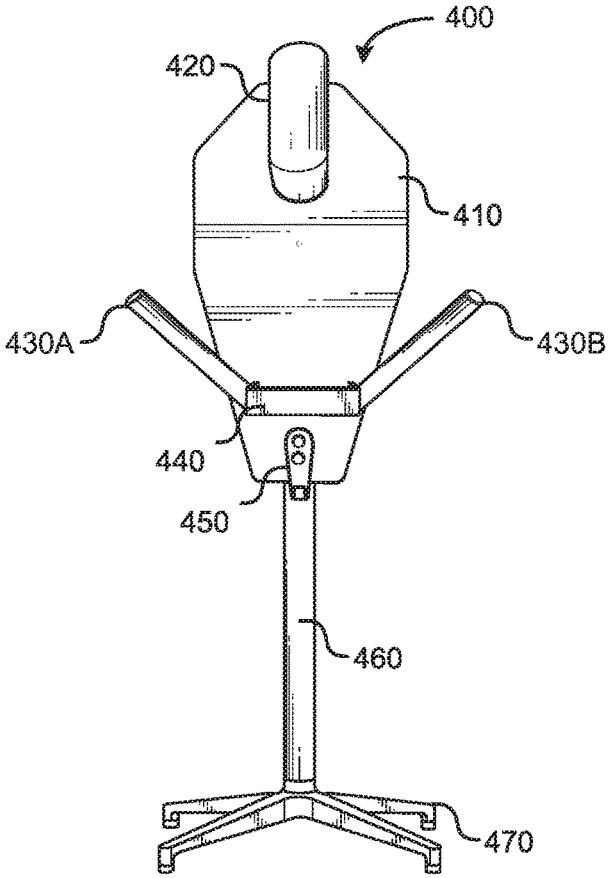
FIG. 4 is a diagram illustrating an exemplary single standing rack for displaying and storing gear equipment in accordance with one embodiment described herein.

FIG. 4 is a diagram illustrating an example single standing rack 400 for displaying and storing gear equipment in accordance with one embodiment described herein. As depicted, the backing 410 of the standing rack 400 is identical to the one illustrated and described in FIGS. 1 and 3. However, instead of having the single rack mounted onto a wall or hanging on a hook, the depicted backing 410 may be attached to a stand 460 with legs 470 for support. Because the backing 410 may be attached to a stand 460 with legs 470 without having to be mounted onto a wall or hook for support, the single standing rack 400 may be easily transported and relocated to various locations with relative ease.

Similar to the single rack mounting rack in FIG. 1, the single standing rack 400 disclosed here in FIG. 4 may also include a helmet display member 420 for supporting exemplary gear equipment such as hats, helmets, and masks; a protruding arm members 430A and 430B for supporting exemplary gear equipment such as gloves; a compartment area 440 for storing miscellaneous items or gear equipment, such as keys, tools, goggles, etc.; and a hook member 450 for hanging exemplary gear equipment such as clothing or sports gear attire by way of example only.

Figure 5:
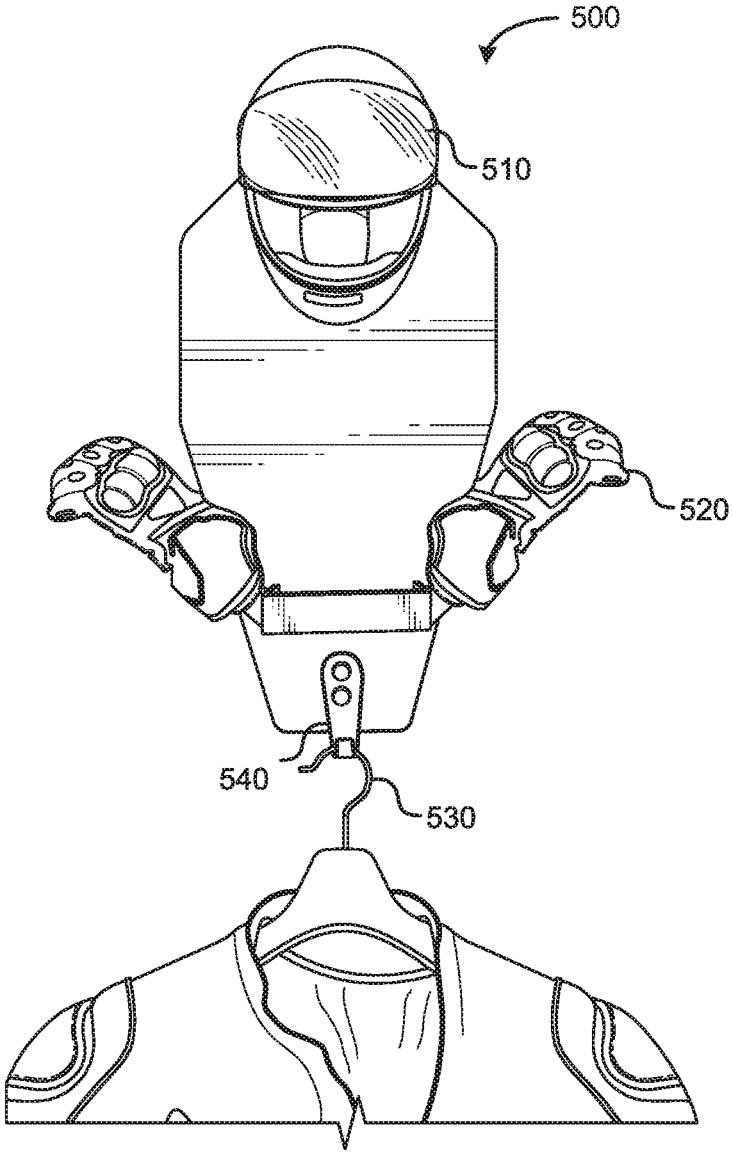
FIG. 5 is a diagram illustrating equipment gear being displayed and stored on an exemplary single mounting rack in accordance with one embodiment described herein.

FIG. 5 is a diagram illustrating equipment gear being displayed and stored on an exemplary single mounting rack 500 in accordance with one embodiment described herein. In this exemplary embodiment, the exemplary equipment gear displayed and stored on the single mounting rack 500 is a complete equipment gear set for a motor bike rider, which may allow the motor bike rider to store and access his or her organized equipment gear with ease. Here, the motorcycle helmet 510 is placed over the helmet display member with a pair of riding gloves 520 placed over the protruding arm members. Also depicted is a motor bike jacket on a hanger 530 placed over a hook member 540. This exemplary configuration allows the equipment gear set to be displayed and stored in an organized and compact fashion. Therefore, the single mounting rack 500 may be configured to display a complete equipment gear set associated with a particular recreational activity. By way of example only, the single mounting rack 500 may display a complete equipment gear set associated with running, football, hockey, motor bike riding, mountain bike riding, wakeboarding, scuba diving, skateboarding, snowboarding/skiing equipment, and any other equipment gear associated with various recreational activities.

Figure 6:
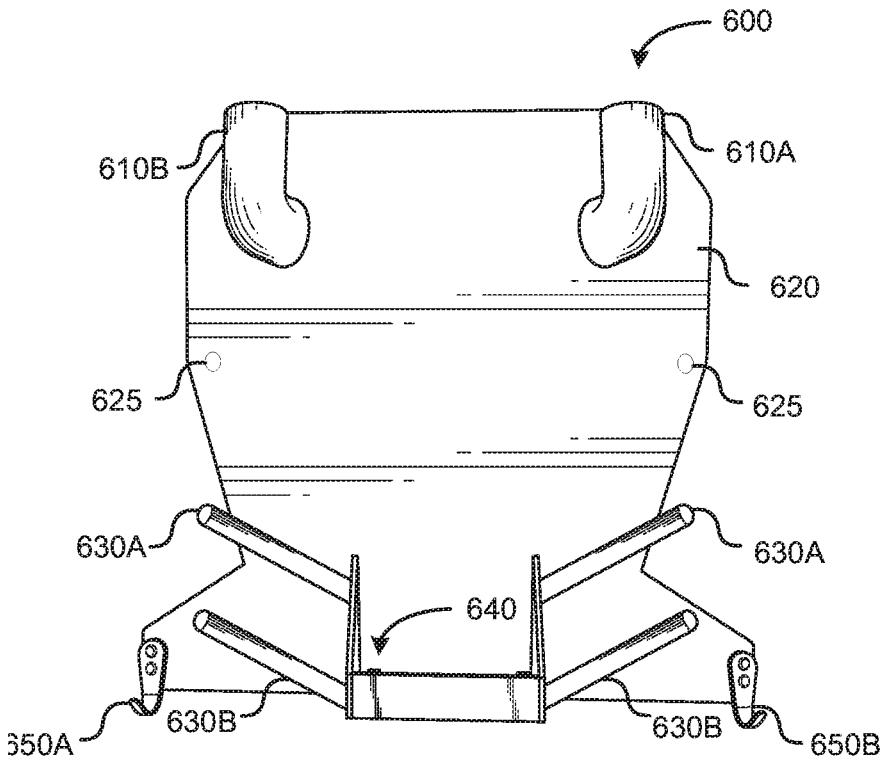
FIG. 6 is a diagram illustrating an exemplary double mounting rack for displaying and storing gear equipment in accordance with one embodiment described herein.

FIG. 6 is a diagram illustrating an exemplary double rack 600 for displaying and storing gear equipment in accordance with one embodiment described herein. As depicted, the double mounting rack 600 is configured to store and display two individual sets of equipment gear.

In some embodiments, the exemplary double mounting rack 600 includes a base or backing 620 with a flat surface, so that the double mounting rack 600 may be hanging flat against a wall. In some instances, the backing 620 may be nailed onto a wall via the mounting holes 625. In other instances, the mounting holes 625 may include a hook receptacle configured to receive a hook (not shown here) so that the single mounting rack 600 may be hanging from a hook attached to a wall or suspended from a ceiling. In some embodiments, the mounting holes may be spaced 162 inches apart, which is the standard distance of stud frames on a wall. As such, the exemplary double mounting rack 600 may be securely mounted onto a wall by having the exemplary double mounting rack 600 mounted to the vertical frames of the wall stud. This allows the exemplary double mounting rack 600 to be securely mounted onto the surface of a wall for displaying heavy equipment gear. However, the distance and location of the mounting holes may be located at various areas at various distances apart.

In some embodiments, the length of the exemplary double mounting rack 600 may have a length that ranges from 15 to 25 inches and a width that ranges from 17 to 27 inches. Furthermore, the backing 620 may be made of wood, metal, injected plastic, vinyl, or any material appreciated by one of ordinary skill in the art studying this disclosure.

By way of example only, the double mounting rack 600 may include two helmet display members 610A and 610B, such that two sets of hats, helmets, or masks may displayed on the double mounting rack 600. The body of the helmet display members 610A and 610B may include an angled protruding body with a top end and a bottom end, such that the top end is configured to receive and support the head piece, such as a hat, helmet, or mask with the second end affixed to the backing 620. By way of example only, the angled protruding body may have an angle ranging from 20 to 90° so that the head piece may be stably displayed without falling off of the helmet display members 610A and 610B.

However, it should be noted that the helmet display members 610A and 610B are not limited to displaying hats, helmets, and masks, and instead, may display any gear equipment that may be stably supported by the helmet display members 610A and 610B. By way of example only, such gear equipment may include clothing, sports gear attire, backpacks, shoes, hats, helmets, masks, goggles, any tools or accessories with a strap member, or any other gear equipment as appreciated by one of ordinary skill in the art studying this disclosure.

In further embodiments, the double rack 600 may also include two pairs of protruding arm members 630A, 630B for displaying gloves. To ensure that the gloves do not fall off the protruding arm members 630A, 630B, the protruding arm members 630A, 630B may be angled anywhere from 20° to 90°. In some embodiments, the two sets of protruding arm members 630A, 630B may each have different angular positions. Again, the protruding arm members 630A, 630B need not be limited to displaying or storing gloves on the double mounting rack 600. Instead, any gear equipment that may be stably displayed on the protruding arm members 630A, 630B may be utilized. For example, such gear equipment may include clothing, sports gear attire, backpacks, shoes, hats, helmets, masks, goggles, any tools or accessories with a strap member, or any other gear equipment as appreciated by one of ordinary skill in the art studying this disclosure.

In some embodiments, the double rack 600 may also include two sets of hook members 650A, 650B, so that clothing or sports gear attire may be hanging on the double rack 600. In some embodiments, the clothing or sports gear attire may be hanging from a hanger, where the hanger is then placed over the hook members 650A, 650B. By way of example only, the clothing or sports gear attire may include wetsuits, motor bike jackets, sports jerseys, sports uniforms, scuba gear, life jackets, etc. In other instances, the clothing or sports gear attire may be directly placed over the hook members 650A, 650B without the use of a hanger.

It should be further noted that the hook members 650A, 650B need not be limited to hanging a hanger or sports gear attire. Instead, the hook members 650A, 650B may be used to hang any gear equipment as appreciated by one of ordinary skill in the art studying this disclosure. Such exemplary equipment gear that may be stably displayed and stored by the hook members 650A, 650B may include hats, helmets, masks, shoes, goggles, tools with a strap member, or any other gear equipment that would be appreciated by one of ordinary skill in the art studying this disclosure.

Figure 7:
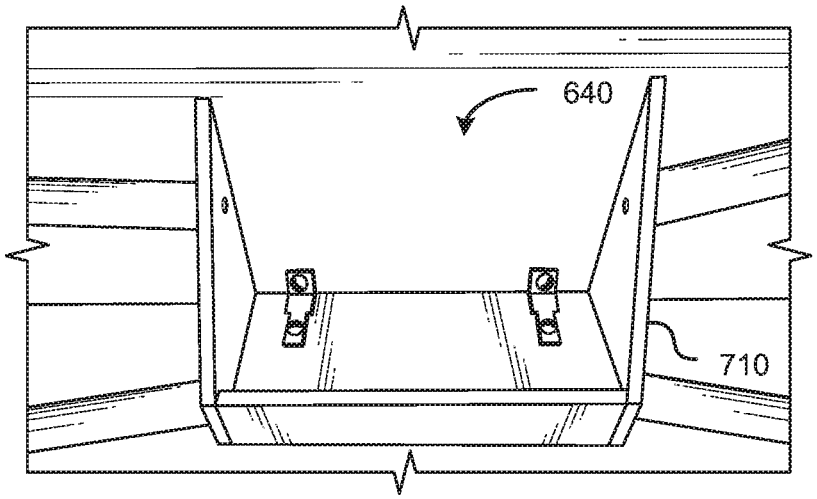
FIG. 7 is a diagram illustrating a compartment area on a double mounting rack for displaying and storing gear equipment in accordance with one embodiment described herein.

In some embodiments, the double mounting rack 600 may include a compartment area 640 for storing other gear equipment that may not have the structural characteristics or properties to be properly displayed on the other structural members of the single mounting rack 600. FIG. 7 depicts a close up view of the compartment area 640 of FIG. 6. As such, FIGS. 6 and 7 will now be explained here together.

As depicted in FIG. 7, the compartment area 640 may include a 3-sided wall 710 attached to the backing 620 of the double mounting rack 600, so that the compartment area 640 is formed to store miscellaneous items that cannot be adequately displayed via the structural support members on the double mounting rack 600. By way of example only, the 3-sided walls 710 may be configured so that the two opposite sides of the 3-sided wall 710 are taller than the front side of the 3-sided wall. This may allow for more miscellaneous items to be stored within the 3-sided walls 710 of the compartment area 640 without falling over. By way of example only, some miscellaneous items that may be stored within the compartment area 640 include goggles, sunglasses, keys, tools, jewelry, chalk, writing utensils, and the like.

Figure 8:
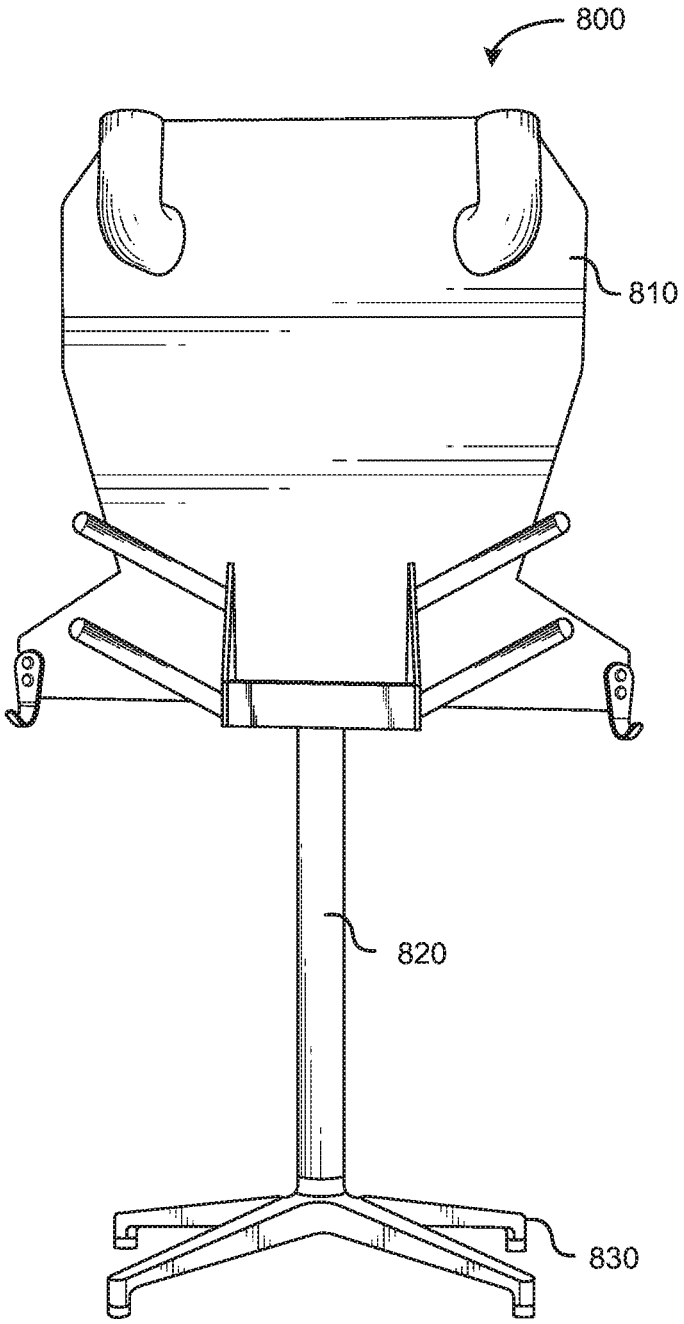
FIG. 8 is a diagram illustrating an exemplary double standing rack for displaying and storing gear equipment in accordance with one embodiment described herein.

FIG. 8 is a diagram illustrating an exemplary double standing rack 800 for displaying and storing gear equipment in accordance with one embodiment described herein. As depicted the backing 820 of the double standing rack 800 is identical to the one illustrated and described with respect to FIG. 6. However, instead of having a double rack 800 configured to be mounted onto a flat surface or a wall via mounting holes, the double rack 800 may be attached to a stand 820 with legs 830 for support. Because the double standing rack 800 may be attached to a stand 820 with legs 830 without having to be mounted onto a wall or hook for support, the double standing rack 800 may be easily transported or relocated to various locations with relative ease.

Figure 9:
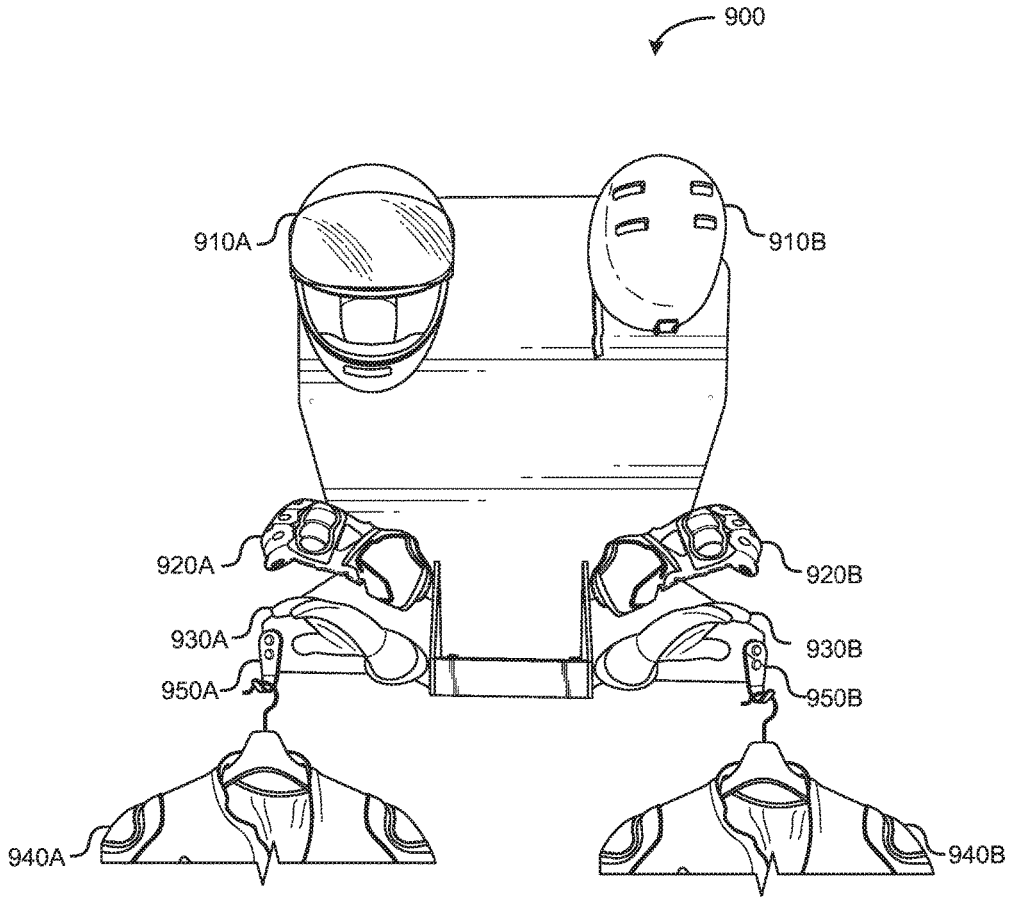
FIG. 9 is a diagram illustrating an exemplary double mounting rack displaying and storing two equipment gear sets in accordance with one embodiment described herein.

FIG. 9 is a diagram illustrating an exemplary double standing rack 900 displaying and storing two different equipment gear sets in accordance with one embodiment described herein. In this exemplary embodiment, the exemplary equipment gears being displayed and stored on the double mounting rack 900 includes a complete equipment gear set of a motor bike rider and a mountain bike rider respectively. The double mounting rack 900 may allow one or more users to have access and store their equipment gear with ease.

Here, the helmets or head pieces 910A and 910B may be placed over the helmet display member with each pair of riding gloves 920A and 920B placed over the protruding arm members. Also depicted are riding jackets 940A and 940B placed over hook members 950A and 950B to display and store uniform or clothing attire. This allows each gear equipment set to be displayed and stored in an easily organized and compact fashion. Therefore, the double mounting rack 900 may be configured to display two different equipment gear sets associated with particular recreational activities. By way of example only, the double mounting rack 900 may display the complete gear equipment sets associated with running, football, hockey, motor bike riding, mountain bike riding, wakeboarding, scuba diving, skateboarding, snowboarding/skiing equipment, and the like.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An equipment gear rack comprising:

a base with a plurality of structural members for displaying two different equipment gear sets comprising:

a first helmet display member and a second helmet display member each comprising an angled protruding body with a top end and a bottom end for supporting a head piece;

a first pair of protruding arm members and a second pair of protruding arm members each comprising a first end and a second end where each of the pair of protruding arm members is positioned at an angle ranging between 20 to 90 degrees and adapted to receive a pair of equipment gear; and a first hook member and a second hook member for hanging an equipment gear on each of the first hook member and the second hook member;

wherein the top end of the angled protruding body is adapted to receive the head piece and the bottom end is affixed to the base of the equipment gear rack;

wherein the first end of the pair of protruding arm members is adapted to receive the equipment gear for display and the second end is affixed to the base of the equipment gear rack.

2. The equipment gear rack of claim 1, further comprising a compartment for storing equipment gear items.

3. The equipment gear rack of claim 1, wherein the base comprises at least a first mounting hole for affixing the equipment gear rack onto a surface of a wall.

4. The equipment gear rack of claim 3, further comprising a second mounting hole.

5. The equipment gear rack of claim 1, wherein the body comprises a stand with feet for supporting the equipment gear rack.

6. A method for displaying equipment gear comprising:

mounting an equipment gear rack onto a surface of a wall, wherein the equipment gear rack comprises:

a base with a plurality of structural members for displaying an equipment gear set comprising:

a first helmet display member and a second helmet display member each comprising an angled protruding body with a top end and a bottom end for supporting a head piece;

a first pair of protruding arm members and a second pair of protruding arm members each comprising a first end and a second end where each of the pair of protruding arms members are adapted to receive a pair of equipment gear; and a first hook member and a second hook member for hanging an equipment gear on each of the first hook member and the second hook member;

wherein the top end of the angled protruding body is adapted to receive the head piece and the bottom end is affixed to the base of the equipment gear rack;

wherein the first end of the pair of protruding arm members are positioned at an angle ranging between 20 to 90 degrees and adapted to receive the equipment gear for display and the second end is affixed to the base of the equipment gear rack.

7. The method of claim 6, wherein the hook member is adapted to hang gear attire for display.

8. The method of claim 6, wherein the base comprises at least a first mounting hole and a second mounting hole.

* * * * *